US005846582A

United States Patent [19]

Mayfield et al.

[11] Patent Number: 5,846,582

[45] Date of Patent: Dec. 8, 1998

[54] VACUUM SKIN PACKAGE FOR SHINGLED FOOD SLICES

[75] Inventors: William D. Mayfield, Simpsonville; Margaret Ann Hague, Greer, both of S.C.

[73] Assignee: Cryovac, Inc., Duncan, S.C.

[21] Appl. No.: 531,527

[22] Filed: Sep. 21, 1995

[51] Int. Cl.[6] ..... B65D 85/00

[52] U.S. Cl. ..... 426/129; 426/87; 426/106; 426/121; 426/125; 426/127

[58] Field of Search ..... 426/87, 125, 121, 426/129, 127, 106

[56] References Cited

U.S. PATENT DOCUMENTS

| | | | |
|---|---|---|---|
| 2,596,514 | 5/1952 | Uehlein | 426/121 |
| 4,552,789 | 11/1985 | Winchell | 426/121 |
| 4,855,183 | 8/1989 | Oberle | 426/129 |
| 4,894,248 | 1/1990 | Pappas et al. | 426/129 |
| 5,077,064 | 12/1991 | Hustad et al. | 426/129 |
| 5,395,632 | 3/1995 | Lawless et al. | 426/129 |
| 5,405,629 | 4/1995 | Marnocha et al. | 426/129 |
| 5,427,807 | 6/1995 | Chum et al. | 426/129 |
| 5,545,420 | 8/1996 | Lipinski et al. | 426/129 |

OTHER PUBLICATIONS

Marilyn Bakker, "The Wiley Encyclopedia of Packaging Technology", pp. 453, 481, 526 and 536 1986.

*Primary Examiner*—Lien Tran
*Attorney, Agent, or Firm*—Thomas C. Lagaly

[57] ABSTRACT

A package for shingled food slices (e.g., sliced bacon), including:

a. a substantially flat support member supporting thereon a group of shingled food slices;

b. a flexible film enclosing the food slices on the support member, the film being sealed to the support member outside the periphery of the food slices and substantially conforming to the shape of the food slices; and c. one or more printed images on at least one of the support member and the flexible film.

12 Claims, 2 Drawing Sheets

VACUUM SKIN PACKAGE FOR SHINGLED FOOD SLICES

BACKGROUND OF THE INVENTION

The present invention relates generally to vacuum skin packages and, more specifically, to vacuum skin packages for shingled food slices such as bacon or other meat or cheese products.

"Shingled food slices" refers to a packaging arrangement wherein a group of individual food slices, e.g., bacon slices, are partially overlaid on one another on a support member such that, with the exception of the first food slice in the group, each slice is partially supported by an adjacent food slice and partially supported by the support member. Bacon slices are often arranged for packaging in this manner.

Shingled food slices are generally packaged on a thermoformed (i.e., heat-shaped) support and enclosed by a polymeric, and preferably transparent, film. Such packages are typically over-wrapped by a rigid external sheet of, e.g., cardboard to provide a surface for the printing of, e.g., source identification, product information, nutritional information, etc. Such external printed sheets, however, add to the expense of the package by necessitating extra materials and processing steps.

Accordingly, a need exists in the art for a vacuum skin package for shingled food slices which does not require an external printed sheet for source identification, product information, etc.

SUMMARY OF THE INVENTION

That need is met by the present invention which provides a package for shingled food slices, comprising:

a. a substantially flat support member supporting thereon a group of shingled food slices;

b. a flexible film enclosing the food slices on the support member, the film being sealed to the support member outside the periphery of the food slices and substantially conforming to the shape of the food slices; and c. one or more printed images on at least one of the support member and the flexible film.

The printed images on the support member and/or flexible film may be a surface-printed or trap-printed image. Such images may convey source identification, product information, nutritional information, etc. In this manner, the need for an external printing sheet is eliminated.

DETAILED DESCRIPTION OF THE PREFERRED EMBODIMENTS

Figure 1:
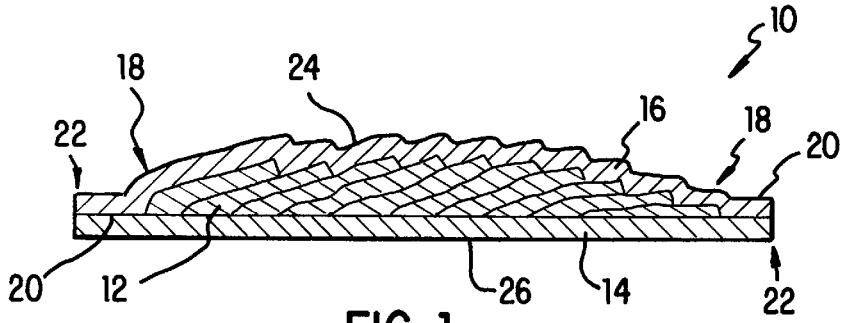
FIG. 1 is a sectional view of a package for shingled food slices in accordance with the present invention.

FIG. 1 illustrates a completed package 10 for shingled food slices 12 in accordance with the present invention. The package is ideally suited for packaging a group of shingled bacon slices, but can also be used to package other types of shingled food slices, such as, e.g., slices of luncheon meat, sausage, cheese, produce, etc.

Package 10 includes a substantially flat support member 14 which supports thereon a group of shingled food slices 12. Flexible film 16 encloses food slices 12 on support member 14. Flexible film 16 is sealed, preferably by heat-sealing as indicated at 20, to support member 14 outside the periphery 18 of food slices 12, i.e., between the periphery 18 of food slices 12 and the periphery 22 of support member 14. Such a seal can be described as a "perimeter seal." In this manner, food slices 12 are completely enclosed by support member 14 and flexible film 16.

As shown in FIG. 1, flexible film 16 substantially conforms to the shape, i.e., the outer contour, of shingled food slices 12 as arranged on support member 14. Such conformational packaging is generally known as "vacuum skin packaging," the method of which will be described below.

To avoid the necessity of using external printing sheets to convey product information and the like, one or more printed images as desired are provided on at least one of support member 14 and flexible film 16. The printed image (s) may be surface-printed or trap-printed. As used herein, a "surface-printed image" is one which has been printed on the outer surface 24 of flexible film 16 and/or the outer surface 26 of support member 14. A "trap-printed image" is one which has been printed within, i.e., on the inside of, flexible film 16 and/or support member 14; that is, the printed image is trapped or sandwiched between adjacent layers of flexible film 16 or support member 14, such layers being bonded together with an adhesive and, optionally, corona treatment. Regardless of whether surface or trap printing is employed, the printed image is preferably applied to flexible film 16 and/or support member 14 prior to forming package 10.

Flexible film 16 may have a thickness ranging from about 1 to about 10 mils, but preferably has a thickness ranging from about 2.5 to about 3.5 mils. Film 16 may be a monolayer film or a multilayer film, and may be formed from any suitable material. Preferably, flexible film 16 comprises one or more materials selected from the group consisting of polyethylene, ethylene/ alpha-olefin copolymer, polypropylene homopolymer, propylene/ethylene copolymer, ethylene/vinyl acetate copolymer, polyamide, ethylene/vinyl alcohol copolymer, and polyester.

Preferred polyethylenes include low density polyethylene (LDPE), such as PE 1042CS15 from the Rexene Corporation.

Suitable ethylene/alpha-olefins include those which are "heterogeneous" (i.e., Ziegler-Natta catalyzed and having a more random molecular weight and compositional distribution) as well as those which are "homogeneous" (i.e., metallocene or otherwise single-site catalyzed and having a more uniform molecular weight and compositional distribution). Specific examples of preferred heterogeneous ethylene/alpha-olefins include linear low density polyethylene (LLDPE) such as Dowlex™ 2244A or Attane™ 4201, both available from Dow Chemical. Suitable homogeneous ethylene/alpha-olefins include those available from Dow Chemical (e.g., AFFINITY™ or ENGAGE™ resins) or from Exxon (e.g., EXACT™ resins).

An example of a polypropylene homopolymer is Escorene™ PD 3345-E5 from Exxon. Suitable propylene/ethylene copolymers and ethylene/vinyl acetate copolymers are also available from Exxon as, e.g., PD 9302 and Escorene™ LD-720.92, respectively.

The term "polyamide" is intended to include polyamides, copolyamides and polyamide terpolymers. Preferred polyamides include nylon 6, which may be obtained from BASF Corporation under such tradenames as, e.g., Ultramid™ KR-4418 and KR-4407F.

The term "polyester" is intended to include polyesters, copolyesters, and polyester terpolymers. Preferred polyesters include polyethylene terephthalate, which is commercially available from such suppliers as DuPont and Eastman Chemical Co.

Suitable ethylene/vinyl alcohol copolymers are commercially available from suppliers such as Nippon Gohsei (e.g., SOARNAL™ ET) and Eval of America (e.g., LC-H101BD).

Support member 14 may comprise any suitable material capable of supporting food slices 12 and providing a desired level of oxygen permeability or impermeability. Preferably, support member 14 is formed from one or more of the same materials as described above with respect to flexible film 16, and has a thickness ranging from about 2.5 to about 3.5 mils. Most preferably, flexible film 16 and support member 14 are formed from identical multilayer films in package 10, except that flexible film 16 conforms to the shape of food slices 12 while support member 14 remains substantially flat. By use of the phrase "substantially flat" to describe support member 14, it is meant that support member 14 is not thermoformed, thereby avoiding extra processing steps which would otherwise be required to provide a thermoformed support member.

In one embodiment, flexible film 16 and/or support member 14 comprise a multilayer film having a first layer of linear low density polyethylene, a second layer of ethylene/vinyl acetate copolymer, a third layer of propylene/ethylene copolymer, a fourth layer of ethylene/vinyl acetate copolymer, a fifth layer of propylene/ethylene copolymer, a sixth layer of ethylene/vinyl acetate copolymer, and a seventh layer of polypropylene. The layers are arranged in the order listed, i.e., the first layer is adjacent and adhered to the second layer, etc. The first layer serves as sealant layer capable of forming heat-seal 20 and is in contact with shingled food slices 12. The seventh layer serves as an abuse-resistant layer and forms outer surfaces 24 and/or 26 of package 10. In comparison with the other multilayer films described hereinbelow, this multilayer film has a relatively high oxygen transmission rate, and so would be useful for packaging shingled food slices which do not require a high oxygen barrier, such as, e.g., sliced vegetable or poultry products.

In another embodiment, flexible film 16 and/or support member 14 comprises a multilayer film having, in order, a first layer of linear low density polyethylene, a second layer of polyamide, a third layer of ethylene/vinyl alcohol copolymer, and a fourth layer of polyamide. As with the previously-described film, the layers are arranged in the order listed with the first layer serving as a sealant layer and being in contact with food slices 12. An adhesive layer, such as, e.g., anhydride-grafted linear low density polyethylene or low density polyethylene, is preferably included between the first and second layers to facilitate the bonding together of those two layers. As used herein, the term "adhesive layer" refers to an interior film layer which has the primary function of bonding two adjacent layers together. Due to the presence of ethylene/vinyl alcohol copolymer, this film provides excellent oxygen-barrier functionality, i.e., provides a low rate of oxygen transmission. As such, the film is ideally suited for highly oxygen-sensitive food slices such as sliced fresh red meat products and, particularly, sliced bacon.

The fourth layer (of polyamide) may serve as an abuse-resistant layer. Preferably, one or more additional abuse-resistant layers are added to the fourth layer. For example, a fifth layer of polyamide may be joined to the fourth layer, preferably with an adhesive such as anhydride-grafted polyolefin in ethylene/vinyl acetate copolymer. As an alternative, a fifth layer of polypropylene may be joined to the fourth layer, preferably with an adhesive such as anhydride-grafted polypropylene. As a further alternative, a fifth layer of low density polyethylene and a sixth layer of polyethylene terephthalate may be added, preferably with an adhesive layer between the fourth and fifth layers (e.g., anhydride-grafted LLDPE) and an adhesive layer between the fifth and sixth layers (e.g., a polyurethane-based adhesive).

Figure 2:
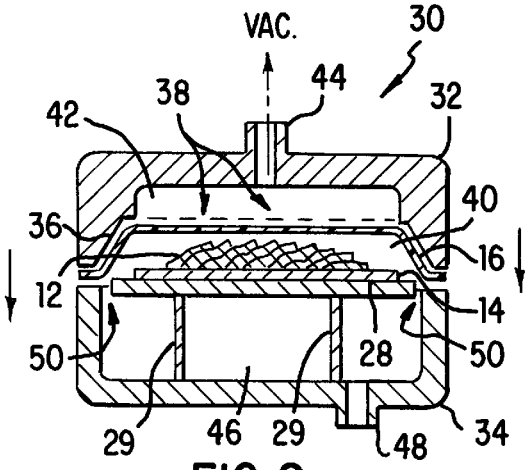
FIG. 2 is a sectional view of a vacuum chamber in which a flexible film is formed into a concave shape by vacuum above a group of shingled food slices on a support member.
Figure 3:
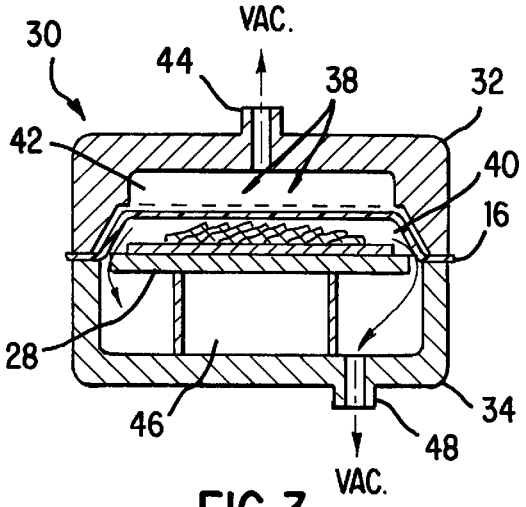
FIG. 3 is a sectional view as in FIG. 2, wherein the space between the support member and flexible film is being evacuated.
Figure 4:
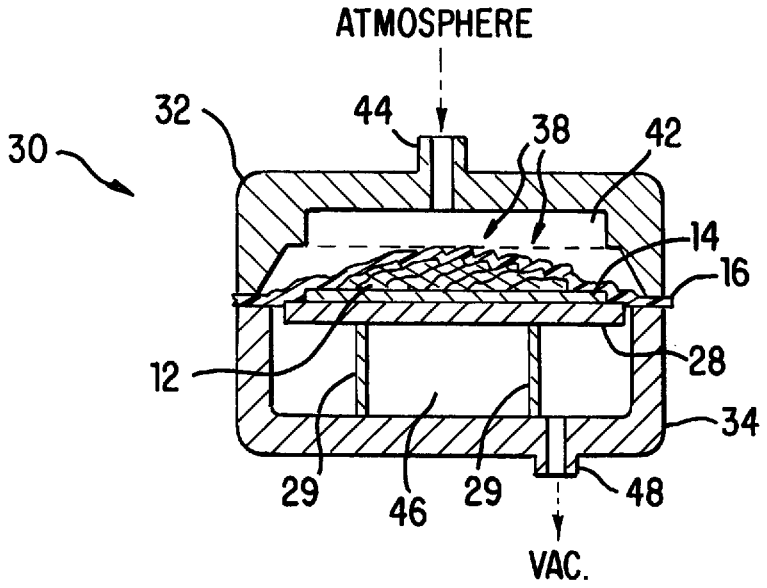
FIG. 4 is a sectional view as in FIG. 3, wherein the flexible film has been moved against the food slices and into sealing engagement with the support member.

Referring now to FIGS. 2–4, a preferred method of preparing a package in accordance with the present invention will be described. Shingled food slices 12, arranged on support member 14, are first placed on platform 28 which is carried by platform supports 29 in vacuum chamber 30. Vacuum chamber 30 includes upper section 32 and lower section 34. Inwardly sloping walls 36 and the horizontal wall portion containing ports 38 define a concave space or cavity 40 within upper section 32. Above the ports 38 is manifold space 42 having an exterior port 44. Lower section 34 has a manifold or cavity region 46 which has an exterior port 48. Lower section 34 further has a passageway to cavity 40 in upper section 32 as defined by the space 50 between lower section 34 and platform 28.

A sheet of flexible film 16 is stretched across the lower opening to upper section 32 and a vacuum, as shown by the arrow and the abbreviation "vac.," is applied to upper section 32 via exterior port 44, manifold space 42, and ports 38, thereby drawing flexible film 16 into a concave form against walls 36 and ports 38 as shown in FIGS. 2 and 3. Any conventional vacuum pump can be used to apply the vacuum. Preferably, flexible film 16 is pre-heated prior to the foregoing operation to render it more pliable and thus better able to assume a concave shape in upper section 32.

As shown in FIG. 2, flexible film 16 shaped into a concave form is positioned over shingled food slices 12 on support member 14. At this point, vacuum chamber 30 has not yet been closed. Closing of the chamber is accomplished by moving upper section 32 down onto lower section 34 as indicated by the arrows in FIG. 2. During this whole sequence of operation as illustrated in FIGS. 2 and 3, vacuum is constantly applied through exterior port 44, manifold space 42, and ports 38 to retain the concave shape of flexible film 16.

In FIG. 3, with the vacuum chamber closed, vacuum is applied through exterior port 48 in lower section 34, as indicated by the downwardly pointing arrow and the abbreviation "vac." Arrows on either side of platform 28 are used to illustrate the evacuation of the gas (air) from the space between support member 14 and flexible film 16. The path of the evacuated gas is from the vicinity of food slices 12, around the peripheral space 50 between lower section 34 and platform 28, into manifold region 46, and out through exterior port 48. As noted above, during this evacuation of chamber 30, the concave shape of flexible film 16 is retained by continued application of vacuum through exterior port 44, manifold space 42, and ports 38.

In FIG. 4, flexible film 16 is shown collapsed around and formed on shingled food slices 12 and in contact with supporting member 14. Vacuum has been maintained through exterior port 48 and the vacuum through exterior port 44 has been released and atmospheric pressure has been admitted as shown by the downwardly-pointing arrow from the word "atmosphere." The atmospheric pressure through port 44 and vacuum through port 48 serves to cooperatively push and pull, respectively, flexible film 16 into the position shown in FIG. 4 wherein flexible film 16 substantially conforms to the shape of shingled food slices 12 on support member 14.

The end result is the packaged product 10 shown in FIG. 1. Preferably, heatable seal bars or other means (not shown) are provided in vacuum chamber 30 for heat-sealing flexible film 16, as indicated at 20 in FIG. 1, to support member 14 between the periphery 18 of food slices 12 and the periphery 22 of support member 14. Such heatable seal bars apply heat and pressure outside the periphery of food slices 12 to effect the perimeter heat-seal 20. The layers of flexible film 16 and support member 14 which are to be in contact with one another are selected to be heat-sealable to one another. Preferably, a homogeneous ethylene/alpha-olefin copolymer is present in one or both contacting layers of flexible film 16 and support member 14. Such copolymer has been found to provide excellent heat seals.

Alternatively, a pressure-sensitive adhesive may be used on one or both of the contacting surfaces of flexible film 16 and support member 14. In this instance, only pressure and not heat would be required to effect a seal at 20.

If desired, vacuum chamber may be expanded in size to allow multiple packages 10 to be produced simultaneously, including simultaneous evacuation and heat-sealing. In this instance, means are preferably included to reduce or eliminate the incidence of "webbing," i.e., folds of excess film 16 around the packages 10. Such means preferably include vertically-moveable rib members (not shown) on platform 28 to take up excess film as disclosed in U.S. Pat. No. 4,537,011, the disclosure of which is expressly incorporated herein by reference.

The present invention is particularly suitable for packaging shingled food slices where an evacuated package is necessary to extend the shelf lifetime of the product. Various sliced food items require packaging materials having differing moisture vapor transmission rates and oxygen permeability rates. Within the scope of this invention, packaging materials can be selected and used with properties that match the requirements for the packaged food item.

While the invention has been described with reference to the foregoing preferred embodiments, those skilled in the art will understand that various modifications may be made to the invention as described without departing from the scope of the claims which follow.

What is claimed is:

1. A vacuum skin package for shingled food slices, comprising:

a. a substantially flat support member supporting thereon a group of shingled food slices, said support member comprising, in order, a first layer of linear low density polyethylene, a second layer of polyamide, a third layer of ethylene/vinyl alcohol copolymer, and a fourth layer of polyamide;

b. a flexible film enclosing said food slices on said support member, said film being sealed to said support member outside the periphery of said food slices and substantially conforming to the shape of said food slices, said flexible film comprising, in order, a first layer of linear low density polyethylene, a second layer of polyamide, a third layer of ethylene/vinyl alcohol copolymer, and a fourth layer of polyamide; and c. one or more images printed on at least one of said support member and said flexible film.

2. The package of claim 1, wherein said food slices are bacon slices.

3. The package of claim 1, wherein said printed image is a surface-printed image.

4. The package of claim 1, wherein said printed image is a trap-printed image.

5. The package of claim 1, wherein said flexible film has a thickness ranging from about 2.5 to about 3.5 mils.

6. The package of claim 1, wherein said flexible film further comprises a fifth layer of polyamide.

7. The package of claim 1, wherein said flexible film further comprises a fifth layer of polypropylene.

8. The package of claim 1, wherein said flexible film further comprises a fifth layer of low density polyethylene and a sixth layer of polyethylene terephthalate.

9. The package of claim 1, wherein said support member is a film having a thickness ranging from about 2.5 to about 3.5 mils.

10. The package of claim 1, wherein said support member further comprises a fifth layer of polyamide.

11. The package of claim 1, wherein said support member further comprises a fifth layer of polypropylene.

12. The package of claim 1, wherein said support member further comprises a fifth layer of low density polyethylene and a sixth layer of polyethylene terephthalate.

* * * * *